United States Patent [19]

Tada

[11] 4,424,920

[45] Jan. 10, 1984

[54] PUSH-BUTTON TYPE SPRAYER

[75] Inventor: Tetsuya Tada, Tokyo, Japan

[73] Assignee: Canyon Corporation, Tokyo, Japan

[21] Appl. No.: 249,100

[22] Filed: Mar. 30, 1981

[30] Foreign Application Priority Data

Jun. 17, 1980 [JP] Japan ..... 55-83687[U]
Aug. 18, 1980 [JP] Japan ..... 55-116487[U]

[51] Int. Cl.[3] ..... B65D 83/00
[52] U.S. Cl. ..... 222/402.11; 222/153
[58] Field of Search ..... 222/153, 402.11, 402.13, 222/402.14, 402.15, 534, 535, 538, 539, 402.1, 402.12, 182, 135, 533, 536, 526; 128/200.23, 200.14, 203.21

[56] References Cited

U.S. PATENT DOCUMENTS

| | | | |
|---|---|---|---|
| 3,169,672 | 2/1965 | Soffen et al. | 222/402.11 |
| 3,184,116 | 5/1965 | Huling | 222/402.11 |
| 3,263,868 | 8/1966 | Sagarin | 222/182 |
| 3,348,740 | 10/1967 | O'Donnel | 222/153 |
| 3,469,746 | 9/1969 | Melocchi | 222/402.13 |
| 3,622,053 | 11/1971 | Ryden | 222/402.11 |
| 3,642,179 | 2/1972 | Michallef | 222/402.12 |
| 3,651,993 | 3/1972 | Venus, Jr. | 222/153 |
| 3,718,238 | 2/1973 | Hazard et al. | 222/536 |
| 3,848,778 | 11/1974 | Meshberg | 222/402.11 |
| 3,884,392 | 5/1975 | Hazard | 222/153 |
| 4,081,113 | 3/1978 | Hazard | 222/536 |
| 4,142,650 | 3/1979 | Almouli | 222/402.11 |
| 4,171,758 | 10/1979 | Corba | 222/402.11 |

*Primary Examiner*—Joseph J. Rolla
*Assistant Examiner*—Kenneth Noland
*Attorney, Agent, or Firm*—Frishauf, Holtz, Goodman and Woodward

[57] ABSTRACT

A push-button type sprayer comprises a movable push button which is attached to a container containing a liquid to be sprayed. A stopper is formed integrally with the push button to extend along the moving direction of the push button. Formed in the outer peripheral surface of the container is a recess which contains the stopper and has a shoulder portion on which the stopper abuts.

9 Claims, 9 Drawing Figures

PUSH-BUTTON TYPE SPRAYER

BACKGROUND OF THE INVENTION

This invention relates to a push-button type sprayer in which spraying is performed by depressing a movable push button formed on a container containing a liquid to be sprayed.

In general, push-button type sprayers are so constructed that a push button connected to a piston is depressed to pressurize and spray a liquid. There are proposed, however, air-pressurized sprayers in which a push button is disposed independently of a piston and high-pressure air is accumulated in a container by a pumping action of the piston so that a valve may be opened for continuous spraying by depressing the push button. In the push-button type sprayers, spraying is effected by depressing a push button. Therefore, the push button should be depressed only in case of necessity, so that many of the push-button type sprayers are provided with a safety mechanism for preventing careless or unexpected depression of the push button during packing, exhibition, etc. In one such prior art sprayer, the top surface of the push button is covered with a safety guard which is formed integrally with the container so that the push button may be allowed to be pressed down only after the safety guard is removed from the container. With such construction, however, the safety guard cannot be reused, and it is impossible to prevent careless depression of the push button during storage. Especially in a push-button type sprayer which sprays toxic liquids such as insecticide and detergent solutions, it is essential to provide a mechanism, e.g. what is called a child-proof mechanism, for obstructing careless depression of the push button to prevent accidents during storage.

It is therefore an object of this invention to provide a push-button type sprayer of a simple construction eliminating the above-mentioned drawbacks of the prior art sprayers.

To this end, according to the push-button type sprayer of the invention, a stopper extending along the moving direction of a push button is formed integrally with the push button through a hinge therebetween, and a recess containing the stoppr and having a shoulder portion on which the stopper abuts is formed in the outer peripheral surface of the container.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

This invention can be more fully understood from the following detailed description when taken in conjunction with the accompanying drawing.

DETAILED DESCRIPTION

Figure 1:
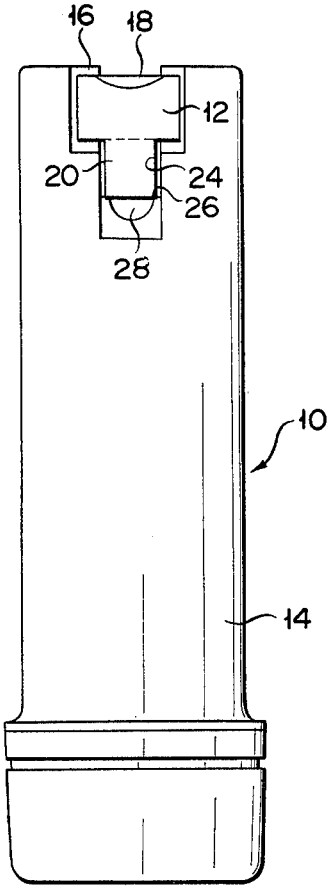
FIGS. 1 to 3 are a rear view, top plan view and a partial broken side view of an air-pressurized sprayer provided with a child-proof mechanism, respectively.
Figure 2:
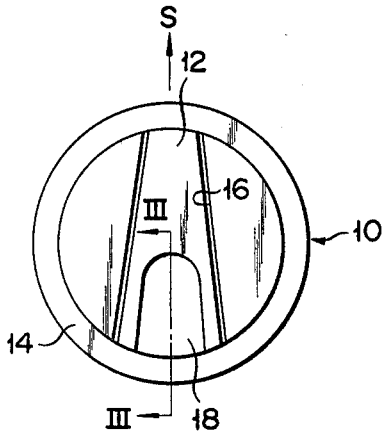
Figure 3:
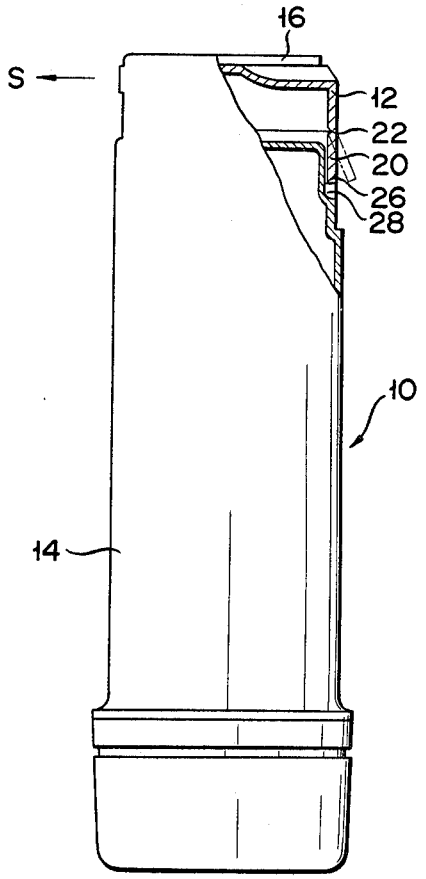

In a push-button type sprayer 10 shown in FIGS. 1 to 3, a push button 12 is descendably disposed inside a recess 16 at the top portion of a container 14 which contains a liquid to be sprayed. When the push button 12 is pressed down, a one-way valve (not shown) opens to cause the liquid to be sprayed in the direction of the arrow S of FIGS. 2 and 3. Formed in the top surface of the push button 12 is a dent 18 for smooth location of an operator's finger. As seen from FIG. 3, a stopper 20 extending downward or along the direction in which the push button 12 is pressed is formed integrally with the push button 12 through a hinge 22. A rectangular recess 24 for containing the stopper 20 is formed in the peripheral surface of the container 12. As seen from FIG. 1, the recess 24 has a shoulder portion 26 against which e.g. the free end of the stopper 20 abuts. Further, a dent 28 in the shape of e.g. a subsphere is formed in the surface of the recess 24 so that a gap is created between the back side of the stopper 20 and the peripheral surface of the container 12 when the dent 28 is partially covered with the free end portion of the stopper.

In the sprayer 10 of the above-mentioned construction, the push button 12 can be prevented from descending by the engagement between the shoulder portion 26 and the free end of the push button 12 even if the push button 12 is pressed. Thus, unexpected depression of the push button 12 can be avoided even during storage as well as during packing and exhibition. The engagement between the stopper 20 and the shoulder portion 26 of the recess 24 can easily be released by swinging the stopper 20 around the hinge 22, as indicated by a one-dot chain line in FIG. 3. By such release of the engagement, the push button 12 is allowed to descend, and the desired spraying operation can be performed with ease by depressing the push button 12 as required. The existence of the dent 28 facilitates the swing of the stopper 20.

Figure 4:
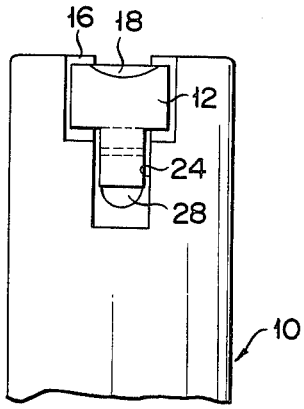
FIGS. 4 and 5 are a partial rear view and a partially broken, partial side view of an air-pressurized sprayer provided with another child-proof mechanism, respectively.
Figure 5:
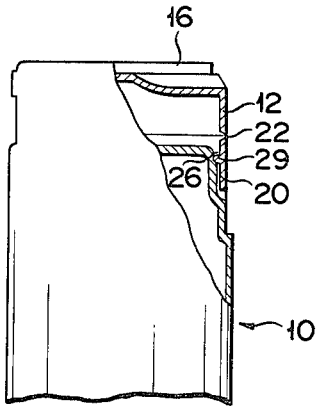
Figure 6:
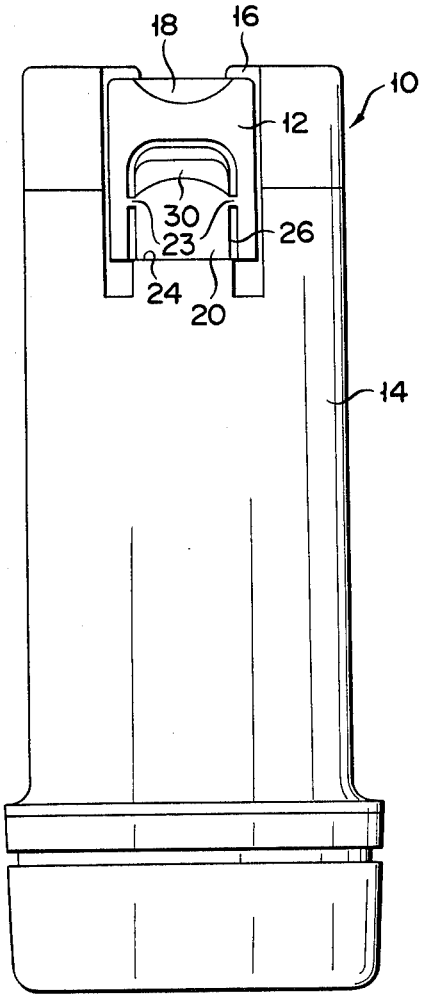
FIGS. 6 and 7 are a rear view and a partially broken, partial side view of an air-pressurized sprayer provided with still another child-proof mechanism, respectively.
Figure 7:
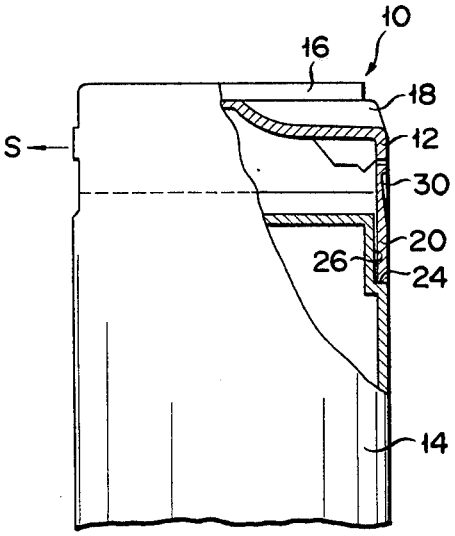
Figure 8:
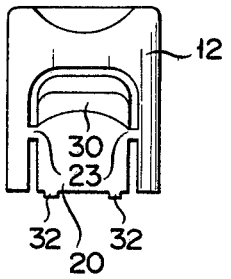
FIGS. 8 and 9 are a front view of a push button of the sprayer shown in FIG. 6 and an enlarged sectional view of a stopper of the push button.

The shoulder portion 26 of the recess 24 need only have a function to prevent the push button 12 from descending, and is not limited to the arrangement of FIGS. 1 to 3 in which it abuts against the free end of the push button 12. As shown in FIGS. 4 and 5, for example, an engaging projection 29 may be projected from the back of the stopper 20 so that the shoulder portion 26 can engage the projection 29. In this case, the dent 28 may be formed greater, so that the stopper 20 can be swung more smoothly.

FIGS. 6 to 9 show another sprayer 10 which includes a seesaw-type stopper 20 formed integrally with the push button 12 through a pair of connecting pieces 23. Formed in the peripheral surface of the container 14 is a recess 26 having a shoulder portion 24 against which e.g. the tip end portion of the stopper 20 abuts.

In the sprayer 10 of the aforesaid construction, the push button 12 is prevented from descending by the engagement between the shoulder portion 24 of the recess 26 and the stopper 20 even if the push button 12 is pressed. The engagement between the stopper 20 and the shoulder portion 24 can easily be released by swinging the stopper 20 in the counterclockwise direction around the connecting pieces 23, as indicated by a one-dot chain line in FIG. 9. By such release of the engagement, the push button 12 is allowed to descend, and the desired spraying operation can be performed with ease by depressing the push button 12 as required.

Figure 9:
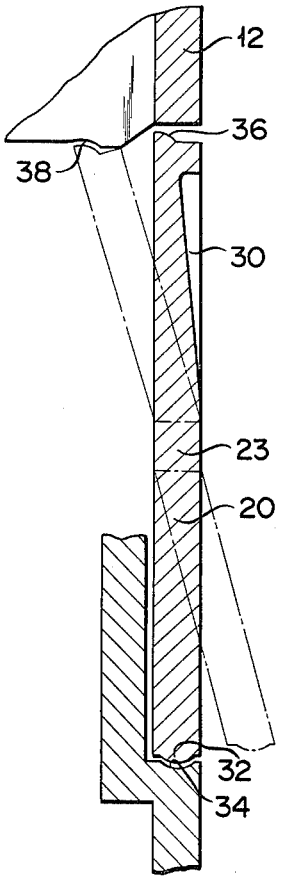

As seen from FIG. 9, with a dent 30 for pressing formed on one end portion of the stopper 20, an operator can tactually perceive the proper portion of the stopper 20 to be pressed without visual recognition, thus enjoying increased operating efficiency. Preferably, moreover, a pair of engaging projections 32 each having e.g. a subcircular cross section are formed on the distal end portion of the stopper 20 and engaging depressions 34 to engage the projections 32 are formed in the shoulder portion 24. Such combination of the engaging projections 32 and the engaging depressions 34 can ensure full engagement between the stopper 20 and the shoulder portion 24 during storage, thereby positively preventing unexpected depression of the push button 12. It goes without saying that the same effect may be obtained if the engaging depressions are formed in the stopper 20 and engaging projections are formed on the shoulder portion 24. In order to prevent the stopper 20 from accidentally engaging the shoulder portion 24 to prohibit the descent of the push button 12 in the middle of a spraying operation, it is advisable to form an engaging projection 36 at the other end portion of the stopper 20 and an engaging depression 38 to engage the projection 36 in the push button 12, for example. With such construction, if the engaging projection 36 is previously engaged with the engaging depression 38, the push button 12 is always kept descendable to be ready for continuous spraying. Also in this case, the same effect may be obtained if the last mentioned engaging depression and engaging projection are formed in the stopper 20 and on the push button 12, respectively.

In the push-button type sprayer according to the invention, as described above, a stopper extending along the direction to press the button is formed integrally with the push button, and a recess containing the stopper and having a shoulder portion to engage the stopper is formed in the peripheral surface of the container. With such construction, the push button is prevented from being depressed unless the engagement between the stopper and the shoulder portion of the recess is released, so that unexpected depression of the push button can perfectly be avoided. Further, spraying is allowed when the stopper is swung around the hinge or connecting pieces, and careless depression of the push button is prohibited when the stopper is shifted again to the position to engage the shoulder portion. Thus, with the child-proof mechanism, the push button can be repeatedly brought to the undescendable or locked state to prevent accidents during storage.

What is claimed is:

1. In a push-button type sprayer mechanism comprising a movable push button attached to a container containing a liquid to be sprayed, the improvement comprising:

a seesaw-type stopper formed integrally with said push button through a pair of spaced-apart connecting pieces which are integrally formed as one piece with both said stopper and said push button, said stopper having ends and extending between said ends along a direction in which said push button is movable, said connecting pieces being interposed between said stopper and said push button at a portion of said stopper intermediate the ends of said stopper, and said stopper being pivotable around said pieces between a first position at which spraying of said liquid is permitted and a second position at which spraying of said liquid is prevented; and a recess formed in the outer peripheral surface of said container to contain said stopper, said recess having a shoulder portion on which said stopper abuts when in said second position to prevent movement of said push button, thereby preventing spraying of said liquid in said container.

2. A push-button type sprayer according to claim 1, wherein said stopper comprises a dent defining pressing area on one end portion thereof, whereby the proper portion of said stopper to be pressed can be tactually perceived.

3. A push-button type sprayer according to claim 2, wherein a combination of an engaging projection and an engaging depression for securing the engagement between said stopper and said shoulder portion is disposed between said stopper and said shoulder portion.

4. A push-button type sprayer according to any one of claims 1 or 3 wherein a combustion of an engaging projection and an engaging depression for maintaining said stopper in a position where said stopper is separated from said shoulder portion is disposed between said stopper and said push button.

5. A push-button type sprayer according to claim 1, wherein said stopper is a generally plate-like member and said ends comprise an upper end portion and a lower end portion, said lower end portion being adapted to abut against said shoulder portion of said recess when said stopper is in said second position, said connecting pieces being arranged intermediate said upper and lower end portions of said stopper.

6. A push-button type sprayer according to claim 1 or 5, wherein said pair of connecting pieces are respectively arranged on opposite sides of said stopper.

7. A push-button type sprayer according to claim 4, wherein said stopper has an upper end portion which is provided with said engaging projection, and wherein said push-button comprises said engaging depression which selectively receives said engaging projection.

8. A push-button type sprayer according to any one of claims 1, 2, 3, or 5, wherein said connecting pieces are bendable.

9. A push-button type sprayer according to claim 6, wherein said connecting pieces are bendable.

* * * * *

UNITED STATES PATENT AND TRADEMARK OFFICE

CERTIFICATE OF CORRECTION

PATENT NO. : 4,424,920

DATED : January 10, 1984

INVENTOR(S) : Tetsuya TADA

It is certified that error appears in the above-identified patent and that said Letters Patent is hereby corrected as shown below:

COLUMN 1, line 57, after "accompanying" change "drawing" to --drawings--;

COLUMN 4 (claim 1), line 12, after "around said" insert --connecting--;

COLUMN 4 (claim 4), line 33, after "claims" change "1 or 3" to --claims 1, 2 or 3,--; change "combustion" to --combination--.

Signed and Sealed this

*Nineteenth* Day of *June 1984*

[SEAL]

*Attest:*

GERALD J. MOSSINGHOFF

*Attesting Officer*

*Commissioner of Patents and Trademarks*